United States Patent [19]

Livick

[11] Patent Number: 4,941,547

[45] Date of Patent: Jul. 17, 1990

[54] SAFETY FEATURED LADDER SCAFFOLDING

[76] Inventor: Lester R. Livick, 15106 Beatty St., San Leandro, Calif. 94579

[21] Appl. No.: 411,900

[22] Filed: Sep. 25, 1989

[51] Int. Cl.[5] ..... E06C 1/04; E06C 5/36; E06C 7/44

[52] U.S. Cl. ..... 182/107; 182/117; 182/200; 182/229; 182/121; 182/214

[58] Field of Search ..... 182/117, 118, 229, 93, 182/107, 200, 121, 214

[56] References Cited

U.S. PATENT DOCUMENTS

| | | | |
|---|---|---|---|
| 1,115,559 | 11/1914 | Mills | 182/229 |
| 2,779,561 | 1/1957 | Blundeau | 182/117 |
| 3,131,784 | 5/1964 | Jackson | 182/229 |
| 3,425,510 | 2/1969 | Fedoryk | 182/117 |
| 3,903,991 | 9/1975 | Phelan | 182/229 |
| 4,078,633 | 3/1978 | Fahy | 182/229 |
| 4,331,217 | 5/1982 | Stecklow | 182/107 |
| 4,394,887 | 7/1983 | Spinks | 182/107 |
| 4,722,420 | 2/1988 | Arthurs | 182/93 |
| 4,792,016 | 12/1988 | Ingalsbe | 182/107 |

*Primary Examiner*—Reinaldo P. Machado
*Attorney, Agent, or Firm*—Linval B. Castle

[57] ABSTRACT

A wall scaffold using a pair of ladders equipped with ladder jacks for supporting a horizontal work platform. The invention includes numerous safety features such as a safety railing on standards attached to the outboard ends of the ladder jacks, a paint bucket trolley for the railing, an adjustable anti-flexing brace between the central part of the ladder and the wall to prevent bouncing of the ladder and platform, a unique safety clamp for tightly securing components to the ladder rungs, a ladder level adjuster, an auxiliary step to assist in mounting and dismounting the work platform, and a safety stake attachable to the lowest ladder rung to prevent bottom "slip-out".

12 Claims, 2 Drawing Sheets

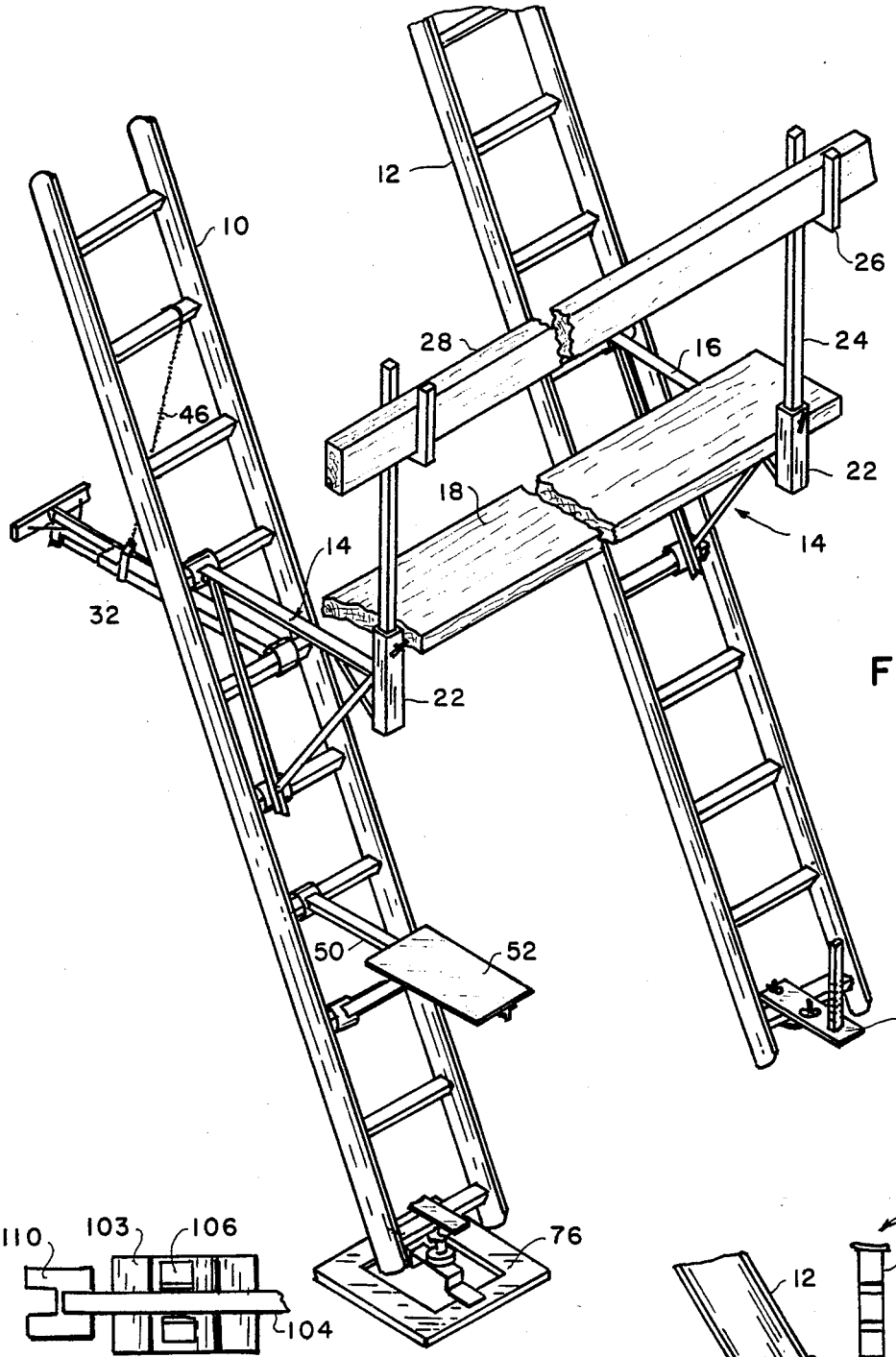
FIG. 1
FIG. 11
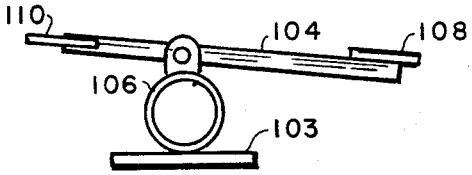
FIG. 10
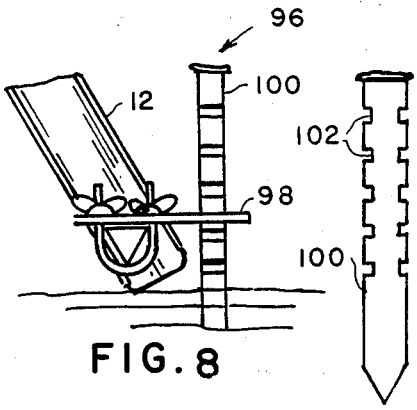
FIG. 8
FIG. 9

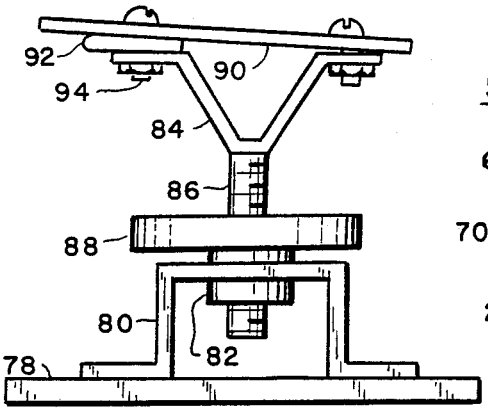
FIG. 7
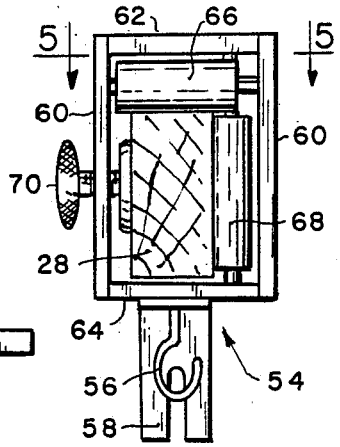
FIG. 4
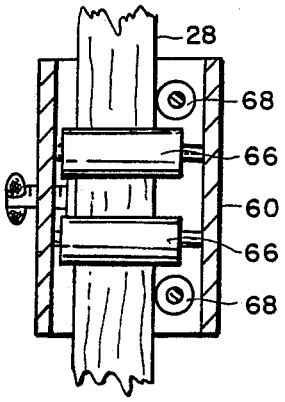
FIG. 5
FIG. 6
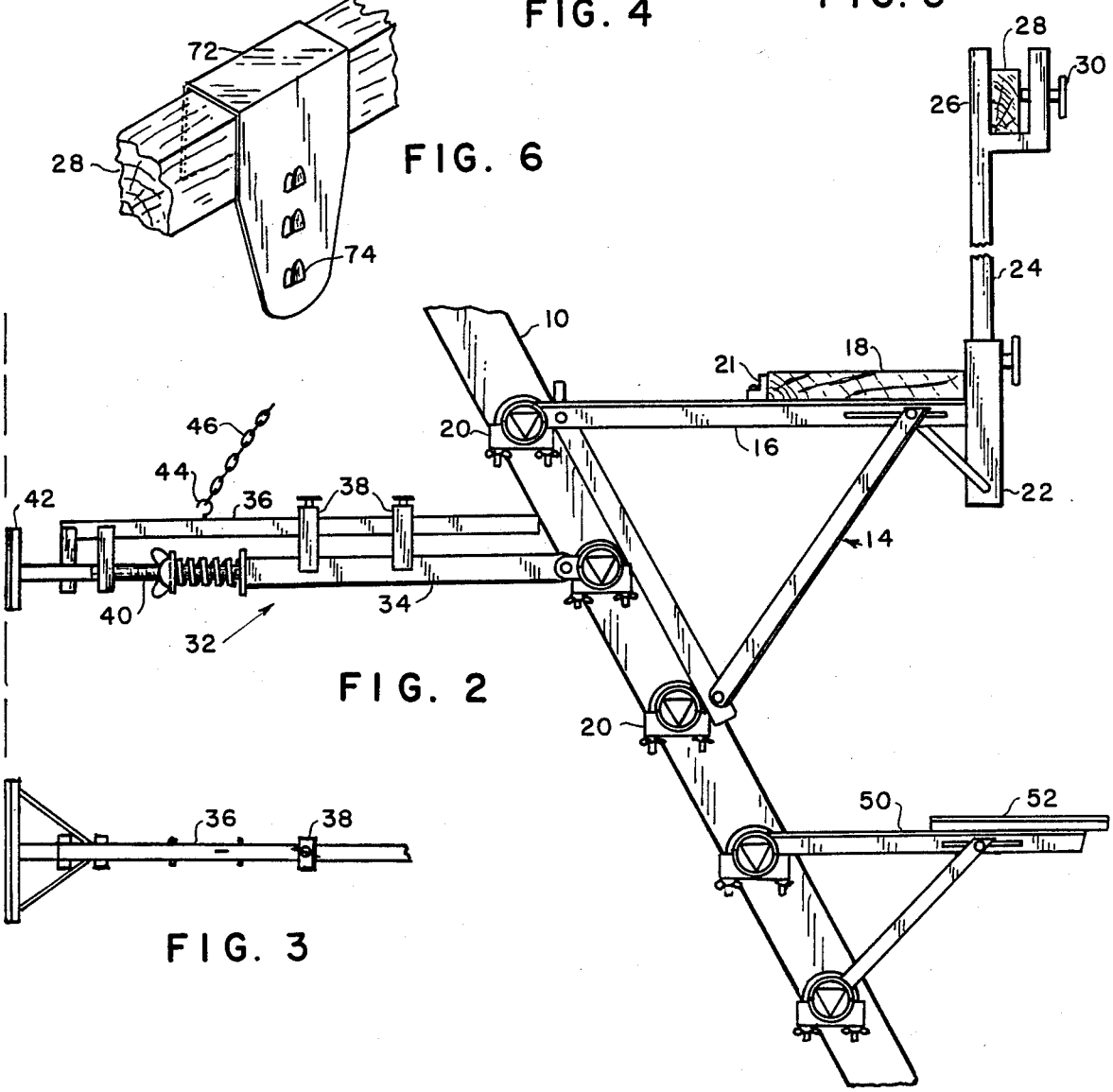
FIG. 2
FIG. 3

SAFETY FEATURED LADDER SCAFFOLDING

BRIEF SUMMARY OF THE INVENTION

This invention relates generally to scaffolding and particularly to safety features of scaffolding formed of ladders.

For the repairs or painting of exterior walls workmen usually stand on the rungs of an extension ladder propped against the wall. In some instances, a pair of spaced stepladders are used with planks supported on facing steps and, on larger jobs, a pair of spaced extension ladders are propped against the wall with planks supported at each end by ladder jacks hung from the ladder rungs. This latter type provides for greater flexibility, wall coverage, and height but, because of the heights, there are inherent dangers to the workmen using the system.

When working high on an extension ladder, there is a problem of ladder flexibility causing the central part of the ladder to bounce or flex toward and away from its supporting structure. If such a flexing is permitted to continue, the lower end of the ladder can easily "walk" out away from the structure, a disadvantage that could result in complete slipping and falling of the ladder. If planking is suspended on ladder jacks hooked over the rungs of spaced ladders, there is a danger of a ladder jack becoming unhooked, also it is very difficult to climb up on the planking and, further, a slight backward misstep from the planking could result in a serious fall.

All of the above disadvantages and dangerous conditions are eliminated in the ladder scaffolding to be described.

The ladders in the scaffolding of the invention is rigidly supported against flexibility by a horizontal length-adjustable anti-flexing brace pivotally coupled between a ladder rung and the structure wall. The lower end of the ladder is prevented from walking out by a metal stake that is driven through a socket secured to the lowest rung of the ladder, and another feature includes a novel leveling adjustment for assuring that the scaffold extends vertically up to a wall and not at an angle that could result is side-slipping and possible falling. An adjustable ladder jack is securely clamped to the rungs of each ladder and may support one or two twelve-inch planks. The ladder jacks support rail standards to which a 2 by 4 safety rail may be clamped. The safety rail may carry a rolling hook for moving a paint bucket or the like along the rail.

BRIEF DESCRIPTION OF THE DRAWINGS

In the drawings which illustrate the preferred embodiment of the invention:

FIG. 1 is a perspective drawing illustrating a pair of spaced ladders equipped with the safety features of the invention;

FIG. 2 is a side elevational view illustrating a ladder with ladder jack, a convenience step, and anti-flexing brace;

FIG. 3 is a top plan view of a portion of the anti-flexing brace;

FIG. 4 an end elevational view of a rolling hook for the safety rail;

FIG. 5 is a sectional plan view taken along the lines 5—5 of FIG. 4;

FIG. 6 illustrates a simple paint can hook for attachment over the safety rail;

FIG. 7 shows a scaffolding level for correcting for variations in the levels of ladder rungs and for non-vertical ladder positions;

FIG. 8 illustrates a stake and stake socket for preventing walk out of a ladder;

FIG. 9 is a side elevational view of the stake of FIG. 8;

FIG. 10 is a side view illustrating a foot-operated stake removal tool; and

FIG. 11 is a partial plan view of the removal tool of FIG. 10.

DETAILED DESCRIPTION

FIG. 1 is a perspective view illustrating the safety features associated with a scaffolding formed with two spaced ladders 10, 12, such as extension ladders, leaning against a wall or building that may require painting. Each ladder supports a ladder jack 14 which is a single triangular frame attached to at least two rungs of a ladder and which has a horizontal member 16 upon which a horizontal plank 18 may be laid as an elevated platform for workers.

Workers on such an elevated platform face the danger of a serious fall unless safety measures are provided. Merely attaching a light weight single frame ladder jack to ladder rungs by open hooks in the conventional manner is a dangerous practice inasmuch as a hook can be accidentally disconnected from the rung and also because a hook permits the single fame to pivot of "hinge" sideways on the ladder. As shown in detail in FIG. 2, the ladder jack and all other safety devices supported by the ladder are firmly secured to the ladder rungs by U-bolted tube around a ladder rung. Most modern extension ladders are aluminum alloy with triangular cross sectioned rungs. These are preferably closely surrounded with a short tubular members that have been longitudinally split into two halves so that the assembly of a U-bolt in its base around the reassembled tube halves around the triangular rung will secure any member welded to a tube half from side movement on a rung.

The ladder jacks 14 are firmly secured to their associated ladders 10 or 12 by the U-bolts 20 as described above, the horizontal members 16 preferably being T-bars extending horizontally outward about two feet so that they may support either one or two 12-inch planks 18. If desired, small studs 21 may be located in the top surface of the member 16 to separate 12-inch planks and to prevent movement of a single plank whenever only one plank is installed. Welded to the outer end of each of the horizontal members 16 and at right angles thereto are tubular sockets 22 for removable rail standards 24.

As shown in FIGS. 1 and 2, the rail standards 24 may be locked in their sockets 22 and extend vertically upward about three feet to a fork 26, the two branches of which are spaced about two inches so that a 2×4 horizontal wooden safety rail 28 may be inserted therebetween. A screw clamp 30, FIG. 2, in the outermost branch will secure the safety rail.

All ladders, particularly aluminum alloy ladders, flex when weight is applied near their centers. Long extension ladders, such as may be used for the scaffolding discussed herein, flex quite freely and the resulting bounce presents a considerable danger to workers on a plank between ladder jacks on spaced ladders propped against a wall. To eliminate such flexing and thus increase safety for workers, an anti-flexing brace 32 is attached by a U-bolt to a rung in one or both ladders 10, 12, as shown in FIG. 1 and in detail in FIG. 2.

The brace 32 includes a square tubular member 34 about three feet in length and having one end pivotally secured to a latter rung. A brace extension 36 slides in locking guides 38 attached to the member 34 and the outer end of the extension supports a threaded rod 40 that enters the outboard end of the member 34. The opposite or outer end of the threaded rod supports a wall pad 42 that will contact the building wall, and a spring and adjustment nut on the threaded rod provide for a suitable length and force adjustment of the brace extension 36, prior to locking the guides 36, so that ladder flexing is eliminated. A plan view of the wall pad 42 is shown in FIG. 3. A small chain 46 engaging hook 44 located on the top surface of the brace 32 extends up to a larger hook 48 that may engage an appropriate higher rung in the ladder or may loop over a rung and drop down to engage a link in the chain to thus maintain the anti-flexing brace 32 in an approximately horizontal position and against the building wall.

With one or two planks 18 installed on the ladder jacks 14, it is quite difficult and thus dangerous for a worker to climb a ladder and to mount and dismount the plank 18. It is therefore practical to add another smaller ladder jack 50 for supporting a shelf 52 that will act as a step for the worker. The shelf 52 should extend about two feet from the ladder and preferably has a rubberized or other non-skid top surface.

FIG. 4 is an end elevational view of a trolley or rolling hook 54 that may be suspended from the 2×4 safety rail 28 prior to its installation on the rail standards 24. Instead of the unsafe practice of storing a container on the planks, the rolling hook provides a safe and convenient carrier for paint cans or other containers having a bail that can be hung from a depending hook 56 and aligned by a depending bifurcated bar 58 adjacent the hook. The rolling hook 54 preferably has two sidewalls 60, a top 62 and bottom 64 that supports the hook 56 and bar 58. Suspended high near the top 62 and between the interior sidewalls are a pair of spaced horizontal rollers 66 and adjacent one interior sidewall 60 are a pair of spaced vertical rollers 68, as best shown in FIG. 5. The horizontal and vertical rollers permit the rolling hook 54 to be freely moved along the safety rail 28 until locked in a desired position by the clamp 70 threaded through the sidewall opposite the vertical rollers 68.

A simpler but non-rolling bail hook is shown in FIG. 6 and comprises a sheet metal strip 72 bent around the 2×4 safety rail 28 with one side extending down and having several hook elements 74 formed by making several U-shaped cuts through the metal and bending each "U" up to form the hook.

In the assembly of a ladder scaffolding such as shown in FIG. 1, it is essential that both ladders lean substantially vertically against the wall so that they will not slip to the side and it is also necessary that the rungs of both ladders upon which the ladder jacks 14 are to be attached are of equal height so that the planks 18 laid across the jacks are substantially level.

FIGS. 1 and 7 illustrate a scaffold level adjuster 76 comprising a flat base 78, an arched frame 80 welded to the top surface of the base and extending up about three inches to a flat section, a tubular member 82 secured in the flat section and having a smooth vertically aligned bore about one inch in diameter, a ladder rung clamp 84 with a threaded one-inch vertical shaft 86 that may slide into the tubular member 82, and a threaded nut 88 threaded on the shaft 86 and which rides on the top surface of the tubular member. Rotation of the nut 88 thus raises or lowers the ladder rung clamp 84 to raise or lower one side of the ladder or lift the entire ladder for leveling the scaffolding. It will be noted that the ladder rung clamp has been shown to be triangular to conform to the modern aluminum alloy ladder rungs with the top clamping bar 90 adjustable to conform to the step portion of the rung. To provide for angular variations in a rung, a wedge 92 having a slot for receiving the maching screw 94 may be inserted, as shown.

FIGS. 1 and 8 illustrate a safety stake assembly 96 for preventing horizontal slippage of the base of a scaffold ladder on unpaved ground. The assembly includes a flat rectangular plate 98 having one end secured to the lowest ladder rung by a U-bolt, the opposite end having a hole therethrough for receiving a metal stake 100 which is driven into the ground to secure the ladder base to the ground to prevent ladder slippage. As shown in FIG. 9, the stake is formed with a plurality of horizontally aligned slots 102 about a half-inch wide and half-inch deep. These slots 102 do not engage the plate 98 but provide a means for removal of the stake from hard ground as will now be described.

FIG. 10 is an elevational view of a stake removal tool used in connection with the stake 100. The removal tool includes a flat base 103, a foot operated pedal bar 104 about two feet in length, and a fulcrum 106 about three inches high firmly attached to the base 103. The bar 104 is pivotally coupled to the fulcrum 106 at a point about two-thirds the length of the bar from a foot pedal 108 and on the end of the bar opposite the pedal 108 is a substantially horizontal plate 110 having a rectangular slot cut in the end for engaging the slots 102 in the stakes 100 as shown in FIG. 11. In use, one merely inserts the rectangular slot of the plate 110 into the lowest exposed slot 102 of a stake and press downward on the pedal 108 to easily lift the stake.

It will be appreciated that the purpose of the invention disclosed herein is to provide safety for workers who must work on scaffolding. I have therefore provided a securing device for positive clamping of a ladder jack and other devices to the rungs of a ladder, an adjustable anti-flexing brace to prevent inward "bouncing" of a ladder, a ladder with a safety rail to prevent falling from a scaffolding, a convenient safety rail rolling hook for holding a container with a bail to eliminate the need to store the container on the scaffold planks, a ladder level adjuster for leveling scaffold planks and for adjusting the vertical alignment of a ladder, and a ladder base anchor for preventing the bottom of a ladder from slipping out.

Having thus described my invention, what I claim is as follows:

1. A wall supported scaffold formed of first and second ladders each having a lower end and a top end and a plurality of substantially equally spaced rungs, said ladders being spaced apart with their top ends leaning against a common wall, said scaffold including:

a ladder jack secured by rung locking means to each of said ladders, said jack having a substantially horizontal platform plank supporting member; and an antiflexing brace coupled between a rung on each of said ladders and the common wall, said brace having a tubular member with first and second ends, the first end of said tubular member being pivotally secured by rung locking means to a rung of its ladder, a second member having first and second ends, the first end of said second member being slideable into bore in the second end of said tubular member, the second end of said second member supporting a wall pad for contacting said common wall, and an adjustment member overlying said tubular member and attached to the second end of said second member for adjusting and locking the overall length of said antiflexing brace.

2. The scaffold claimed in claim 1 wherein said rung locking means includes a cylinder longitudinally split into first and second halves for tight reassembly around a ladder rung and securing means for tightly securing together said first and second halves, one of said halves being weldable to a member to be attached to said rung.

3. The scaffold claimed in claim 2 wherein said securing means is a U-bolt and U-bolt base.

4. The scaffold claimed in claim 2 further including an auxiliary platform step attached to a ladder jack to said ladder rungs by said rung locking means and extending from said ladder for assisting in the mounting and dismounting of a work platform.

5. The scaffold claimed in claim 2 further including a socket member attached to the outboard end of each of said horizontal plank supporting members, said socket being substantially vertically aligned.

6. The scaffold claimed in claim 5 further including a rail standard insertable into said socket member, said standard having a lower end insertable into said socket member and a bifurcated upper end for receiving and securing a safety rail having a top surface and first and second side surfaces.

7. The scaffold claimed in claim 6 further including a rolling hook assembly for moving a bailed container along said safety rail, said rolling hook including a housing containing at least one horizontal roller contacting the top surface of said rail, at least one vertical roller contacting the first side surface of said rail, and a screw lock for contacting the second side surface of said rail.

8. The scaffold claimed in claim 6 further including a bail hook comprising a metal strip formed around the top surface and first and second side surfaces of said safety rail and having a plurality of outwardly extending hooks formed in at least one side surface.

9. The scaffold claimed in claim 1 further including a level adjuster attachable to the lowest rung on said ladder, said adjuster having a base, a tubular member attached to said base and having a smooth top surface and a vertical bore, a threaded shaft within said bore and having a ladder rung attachment at its top end, and a rotatable nut threaded on said shaft and bearing on the top surface of said tubular member.

10. The scaffold claimed in claim 1 further including a safety stake assembly including a plate member secured to the lowest rung of a ladder and extending substantially horizontally outward from said rung, said plate having an opening therethrough for a stake which, when driven into the ground, prevents movement of the bottom end of said ladder.

11. The scaffold claimed in claim 10 further including a metal safety stake for passing through said opening in said plate menter, said stake having spaced slots in opposite sides for receiving the forked end of a stake removal tool.

12. The scaffold claimed in claim 11 wherein said stake removal tool inclused an elongated bar having a bifurcated first end for engaging the slots in said safety stake, a foot pedal at the second end, and a raised fulcrum between said first and second ends.

* * * * *